US010173750B2

(12) United States Patent
Kormann

(10) Patent No.: US 10,173,750 B2
(45) Date of Patent: Jan. 8, 2019

(54) TRIMARAN HAVING A PIVOTABLE OUTRIGGER

(76) Inventor: Oliver Kormann, Salzburg (AT)

( * ) Notice: Subject to any disclaimer, the term of this patent is extended or adjusted under 35 U.S.C. 154(b) by 1120 days.

(21) Appl. No.: 13/704,371

(22) PCT Filed: Jun. 10, 2011

(86) PCT No.: PCT/EP2011/059714
§ 371 (c)(1),
(2), (4) Date: Dec. 14, 2012

(87) PCT Pub. No.: WO2011/157660
PCT Pub. Date: Dec. 22, 2011

(65) Prior Publication Data

US 2013/0081565 A1 Apr. 4, 2013

(30) Foreign Application Priority Data

Jun. 14, 2010 (AT) ..... A 978/2010

(51) Int. Cl.
*B63B 1/10* (2006.01)
*B63B 1/14* (2006.01)
*B63B 1/24* (2006.01)
*B63B 1/30* (2006.01)

(52) U.S. Cl.
CPC ..... *B63B 1/14* (2013.01); *B63B 1/10* (2013.01); *B63B 1/24* (2013.01); *B63B 1/242* (2013.01); *B63B 1/30* (2013.01)

(58) Field of Classification Search
CPC ..... B63B 1/10; B63B 1/14; B63B 2001/145; B63B 1/16; B63B 1/18; B63B 2001/186; B63B 2001/203; B63B 2001/204; B63B 2001/209; B63B 1/24; B63B 1/242; B63B 1/30; B63C 7/003
USPC ..... 114/39.26–39.28, 61.1, 61.11, 114/61.15–61.19
See application file for complete search history.

(56) References Cited

U.S. PATENT DOCUMENTS 2,271,065 A * 1/1942 Dornier, Jr. ..... 244/105
2,678,018 A * 5/1954 Crisp ..... 114/123
3,236,202 A * 2/1966 Quady et al. ..... 114/279
3,787,910 A * 1/1974 Taylor ..... B63C 13/00 114/283
4,337,543 A * 7/1982 Van Ulzen ..... 114/354
4,354,290 A * 10/1982 Tevruchte et al. ..... 114/344
4,457,248 A * 7/1984 Thurston ..... 114/61.11
5,277,142 A * 1/1994 Connor ..... B63B 1/14 114/283
5,315,947 A * 5/1994 Knight ..... 114/61.15
5,809,923 A * 9/1998 Yilmaz ..... B63B 1/14 114/362
5,937,777 A * 8/1999 Azima ..... B63B 1/042 114/123
6,089,173 A * 7/2000 Lande ..... 114/39.23
(Continued)

FOREIGN PATENT DOCUMENTS

DE 3326942 A1 * 2/1984 ..... B63B 1/14
DE 19963423 A1 * 7/2001 ..... B63B 1/12
(Continued)

*Primary Examiner* — Ajay Vasudeva
(74) *Attorney, Agent, or Firm* — Jordan IP Law, LLC; Todd A. Vaughn

(57) ABSTRACT

To a watercraft which includes a main hull and at least one outrigger which is fastened in a height-adjustable manner to the main hull.

14 Claims, 20 Drawing Sheets

(56) References Cited

U.S. PATENT DOCUMENTS

| | | | | |
|---|---|---|---|---|
| 6,588,352 | B2 * | 7/2003 | Kay | B63B 1/04<br>114/61.12 |
| 6,840,825 | B1 * | 1/2005 | Messano | 440/12.52 |

FOREIGN PATENT DOCUMENTS

| | | | | |
|---|---|---|---|---|
| IT | WO 2011141941 | A1 * | 11/2011 | B63B 7/00 |
| WO | WO 9216405 | A1 * | 10/1992 | B63B 1/14 |
| WO | WO 9312970 | A1 * | 7/1993 | B63B 39/06 |

* cited by examiner

TRIMARAN HAVING A PIVOTABLE OUTRIGGER

CROSS-REFERENCE TO RELATED APPLICATIONS

The present application is a National Stage Application of PCT International Application No. PCT/EP2011/059714 (filed on Jun. 6, 2011), under 35 U.S.C. §371, which claims priority to Austrian Patent Application No. A978/2010 (filed on Jun. 14, 2010), which are each hereby incorporated by reference in their respective entireties.

FIELD OF THE INVENTION

Embodiments of the present invention relates to a watercraft, comprising a main hull and at least one outrigger which is adjustably attached to the main hull.

BACKGROUND OF THE INVENTION

It is known to fit watercraft with outriggers which are arranged on the side adjacent to the main hull. Stability can substantially be increased in this way and capsizing becomes virtually impossible.

It is not desirable to use outriggers for all fields of application because they have an influence on the dynamic properties of the watercraft.

A watercraft is known from U.S. Pat. No. 5,373,799 that comprises movable outriggers. As a result, space can be saved during storage. The driving properties cannot be changed fundamentally however.

SUMMARY OF THE INVENTION

It is the object of the present invention to provide a solution which enables a substantially more extensive variability than previously known constructions. In particular, an extremely sportive and maneuverable behavior of a racing boat shall be combined with the sturdiness of an outrigger boat.

It is provided in accordance with the invention that the outrigger is arranged in a height-adjustable manner. The height adjustment can optionally be provided in addition to an adjustment in the width. This allows substantially changing and influencing the driving properties of the watercraft.

It is mechanically especially advantageous when the outrigger is pivotably arranged on the main hull. As a result, an especially large movement range can be realized with simple means. Preferably, the pivoting device is arranged as a parallelogram guide.

An especially preferred embodiment of the invention is arranged in such a way that the outrigger can be moved from a position disposed laterally adjacent to the main hull to a position arranged beneath the main hull.

The present invention allows providing racing boat characteristics that principally show little stability in addition to the characteristics of an outrigger boat, which racing boat characteristics offer extreme lateral positions and favorable driving behavior at highest speeds.

It is provided in an especially preferred manner that at least two outriggers are disposed directly adjacent to one another in the position arranged beneath the main hull and preferably form a common compact hull. Especially advantageous hydrodynamic properties can consequently also be achieved in this position of the outriggers. In particular, maneuverability and driving behavior can be improved.

An even larger extension of the range of applications can be achieved when at least one outrigger can be moved from a position laterally adjacent to the main hull to a position arranged above the main hull.

It is also advantageous when at least two outriggers are pivotably arranged independent from one another. As a result, a capsized boat can be moved upright again simply by suitable movement of the outriggers for example. It is also possible to achieve advantages while travelling through curves.

An especially sportive configuration can be achieved when at least two outriggers are respectively pivotable about a pivoting axis to a position arranged at a distance beneath the main hull.

Critical situations with lack of stability can be avoided for example in such a way that a device is provided for the automatic movement of the outrigger, which device—beneath a predetermined minimum speed of the watercraft—moves the outrigger to the position arranged laterally adjacent to the main hull. Similarly, an automatic system can move the outrigger beneath the main hull at higher speeds.

Preferably, hydrofoils are arranged on at least one outrigger. It is known to provide watercraft with hydrofoils which allow lifting the hull from the water from a specific minimum speed. As a result, flow resistance can be reduced considerably and higher speeds at lower fuel consumption can be achieved. Furthermore, driving behavior which is substantially uninfluenced by the swell can substantially improve comfort.

The hydrofoils are usually attached to the outriggers at sufficient distance beneath the hull in order to thereby reach the required height in hydrofoil operation. In standstill or at low travelling speeds, this leads to high draft with the likelihood of damage to the hydrofoils by obstructions under water.

This also leads to the consequence that hydrofoil craft cannot be operated in shallow water or close to the shore. Furthermore, the sensitive hydrofoils are bulky during transport of the boat and can therefore easily be damaged unless they are dismounted.

In particular, a recess is therefore provided in the hull which accommodates the hydrofoil in the position situated in the region of the hull.

As a result of the proposed solution, disturbances are minimized when the hydrofoil has been retracted, i.e. in displacement operation. The watercraft can therefore also be operated in shallow water and can therefore drive up a beach without any likelihood of damage.

It is especially advantageous from a constructional viewpoint when the hydrofoil is arranged on a telescopically extendable arm. A large adjustment range can be achieved thereby, with the hydrofoil also being optimally situated in intermediate positions.

It is especially advantageous when a drive element such as a jet-ski drive is arranged on the telescopically extendable arm. As a result, not only is a position of the drive achieved which is optimal in all positions of the hydrofoil, but also the introduction of the drive force occurs directly on the component subjected to the flow resistance, leading to a reduction in the material stress.

It is preferably provided that the recess accommodates the drive element and comprises flow channels for the inflow and outflow. As a result, the drive element can also be used when the hydrofoil has been retracted completely in order to achieve minimal draft.

BRIEF DESCRIPTION OF THE DRAWINGS

The present invention will be explained below in closer detail by reference to embodiments shown in the schematic drawings, wherein.

DETAILED DESCRIPTION OF EMBODIMENTS

Figure 1:
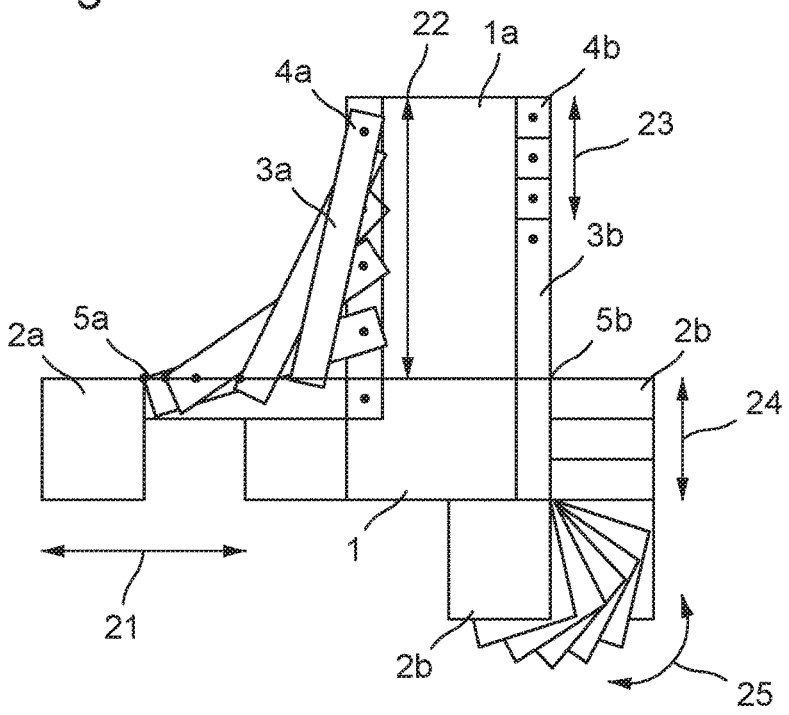
FIGS. 1 to 4 show the kinematics of different embodiments of the invention in form of a schematic cross section.

The embodiment of FIG. 1 shows a main hull 1 with a superstructure 1*a*, on which two outriggers 2*a*, 2*b* are attached via pivoting arms 3*a*, 3*b*. In the borderline case, the main hull can also only includes the superstructure of the mechanism, and therefore, does not mandatorily have a buoyancy function. The outriggers 2*a*, 2*b* can also be fastened directly to the main hull 1. The outriggers 2*a*, 2*b* are linked via first pivoting axes 4*a*, 4*b* to the superstructure 1*a*, while the outriggers 2*a*, 2*b* are linked via second pivoting axes 5*a*, 5*b* to the pivoting arms 3*a*, 3*b*.

The left-hand half of the illustration of FIG. 1 shows the movement of the one outrigger 2*a* from a position resting directly on the main hull 1 to a position arranged laterally at a distance from the main hull 1, i.e. the movement of the outrigger 2*a* corresponding to the double arrow 21. In this process, the first pivoting axis 4*a* is lowered according to the double arrow 22 via a suitable sliding guide and the pivoting arm 3*a* is pivoted accordingly. The outrigger 2*a* does not perform any pivoting movement itself in this movement.

The right half of the illustration of FIG. 1 shows that the right outrigger 2*b* is moved downwardly (double arrow 24) at first by a lowering of the first pivoting axis 4*b* according to the double arrow 23. This is followed by a pivoting movement of the outrigger 2*b* according to the double arrow 25, so that the outrigger 2*b* comes to lie beneath the main hull 1.

It is shown that FIG. 1 shows two different movement modes on the right and left, which are usually performed symmetrically in practice however.

Figure 2:
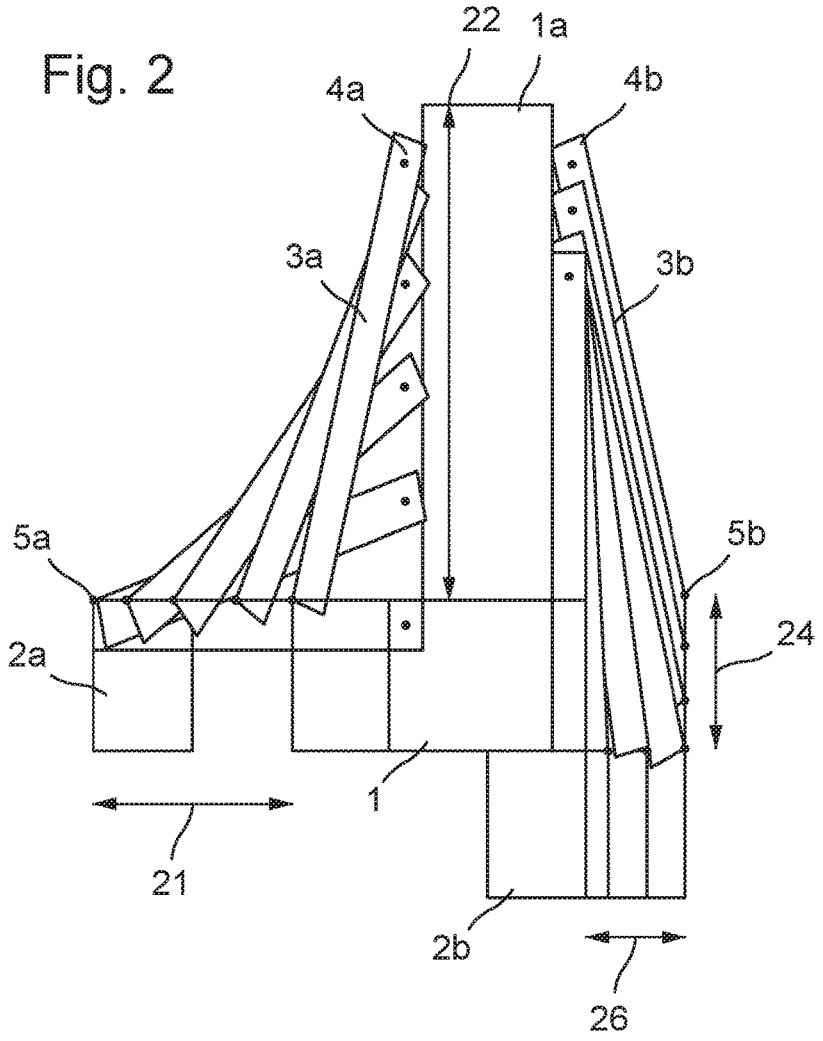

FIG. 2 shows an illustration of an embodiment analogously to FIG. 1, with the difference of this embodiment to the one of FIG. 1 being that the second pivoting axis 5*a*, 5*b* is not linked internally on the outriggers 2*a*, 2*b* but on their outside. The pivoting arms 3*a*, 3*b* are accordingly provided with a slightly longer configuration. The movement of the outrigger 2*a* according to the double arrow 21 shown on the left-hand side occurs substantially analogously to the embodiment of FIG. 1. The movement of the outrigger 2*b* to a position beneath the main hull 1 has been achieved differently. The outrigger 2*b* is moved first downwardly according to the double arrow 24 with obliquely positioned pivoting arm 3*b*, and thereafter the pivoting arm 3*b* will be pivoted in a clockwise direction, so that the outrigger 2*b* will move according to the double arrow 26 to the left downwardly to a position beneath the main hull 1. In contrast to the embodiment of FIG. 1, there will not be any pivoting of the outrigger 2*b* itself in this movement.

Figure 3:
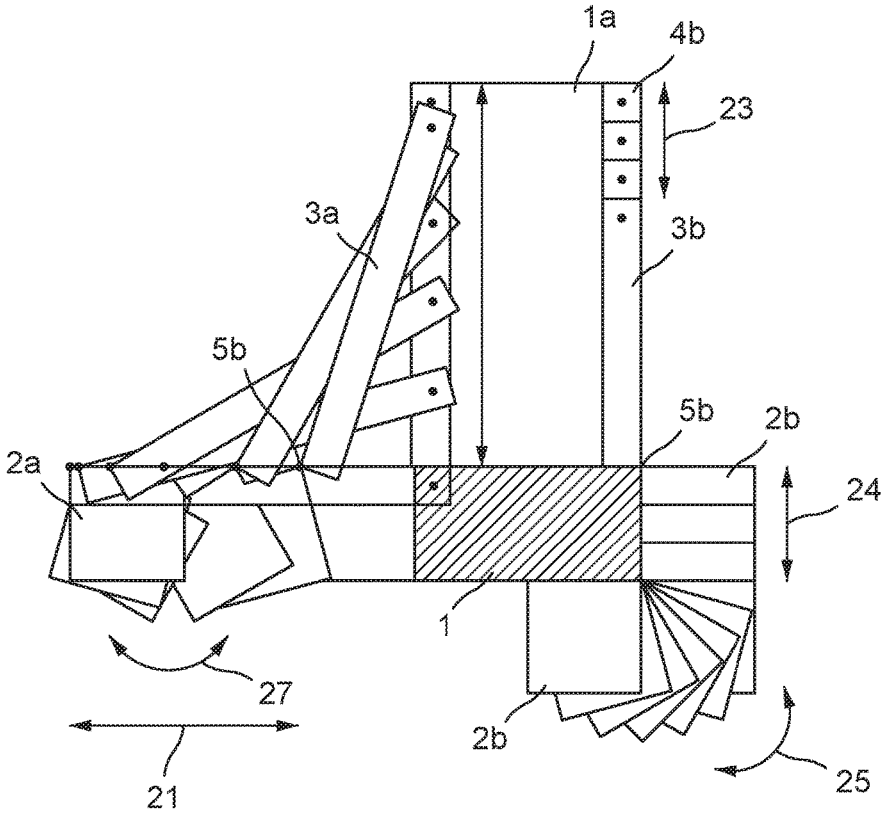

The embodiment of FIG. 3 substantially corresponds in its principal configuration to that of FIG. 1. In particular, the outriggers 2*a*, 2*b* are arranged in their position resting on the main hull 1 in such a way that the second pivoting axis 5*a*, 5*b* is disposed on the inside. The movement illustrated in the right-hand half of FIG. 3 is virtually identical to the movement as shown in FIG. 1. The pivoting of the outrigger 2*a* to its position arranged adjacently to the main hull 1 is different however. In this case, a pivoting movement of the outrigger 2*a* in the anti-clockwise direction (double arrow 27) is performed simultaneously with the pivoting of the pivoting arm 3*a* and the movement of the outrigger 2*a* according to the double arrow 21 away from the main hull 1.

Figure 4:
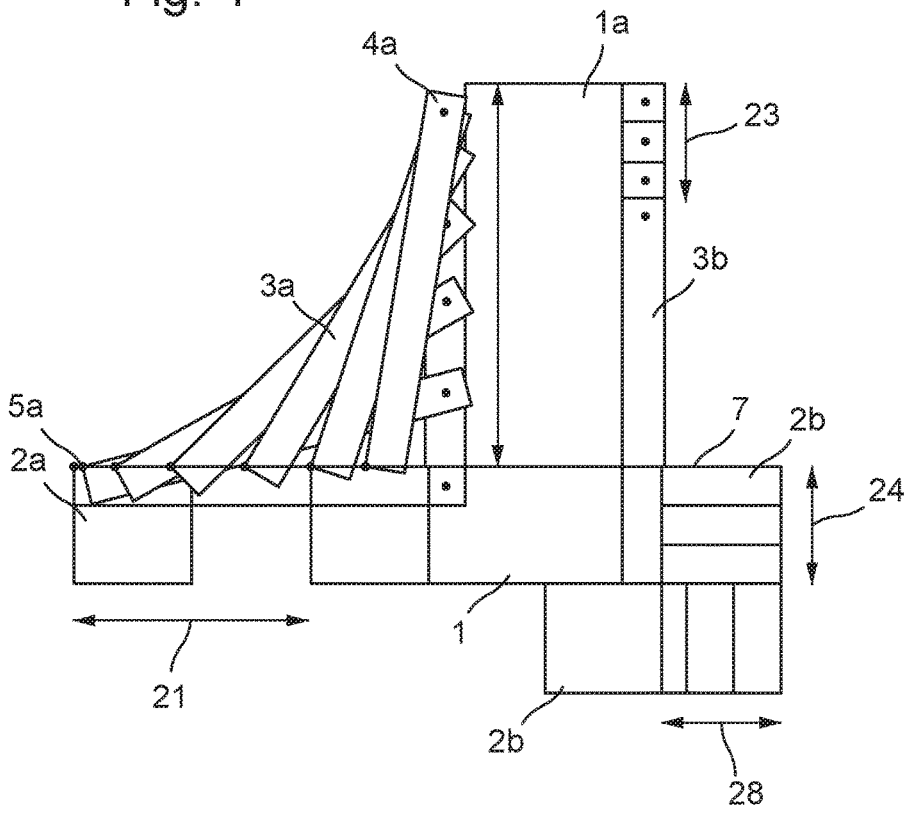

In the embodiment of FIG. 4, which substantially corresponds to that of FIG. 2, the movement of the outrigger 2*a* to its position arranged laterally at a distance from the main hull 1 as shown in the left-hand half of the illustration occurs similarly to the movement of FIG. 2. However, the pivoting arm 3*a* is placed completely on the superstructure 1*a* analogously to FIG. 1 as a result of the mounting of the pivoting axis 5*a* on a sliding guide 7. The movement of the outrigger 2*b* to its position beneath the main hull 1 as shown in the right-hand half of the illustration is also different. The pivoting arm 3*b* is lowered at first according to the double arrow 23 and thereafter the outrigger 2*b* is displaced by means of the sliding guide 7 beneath the main hull 1 (double arrow 28).

Figure 5:
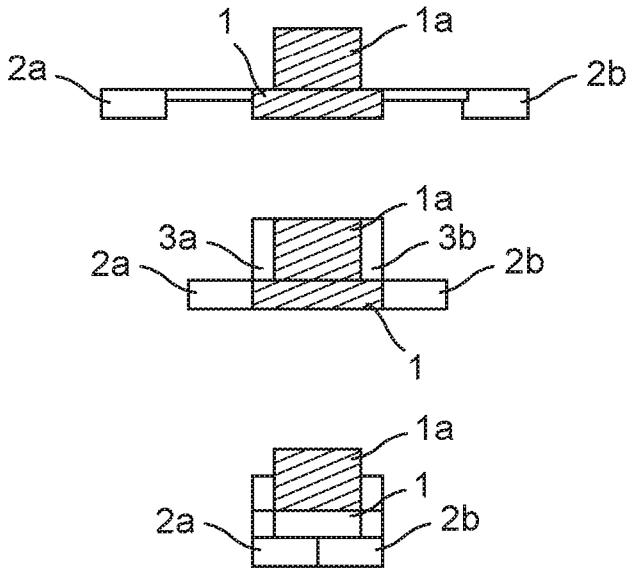
FIG. 5 shows three diagrams for principally explaining the invention.

FIG. 5 schematically shows the three principal positions of the watercraft of this embodiment in accordance with the invention. In the upper position, the two outriggers 2*a*, 2*b* are arranged laterally adjacent to the main hull 1 at a distance therefrom. In the second illustration below, the two outriggers 2*a*, 2*b* rest directly on the main hull 1, and in the third illustration the outriggers 2*a*, 2*b* are positioned in the closed position beneath the main hull 1.

FIGS. 6 to 11 show the embodiments of FIG. 1 and FIG. 2 in the various positions. The left-hand half of the drawings shows the embodiment of FIG. 2, whereas the right-hand half of the drawings shows the embodiment of FIG. 1.

Figure 6:
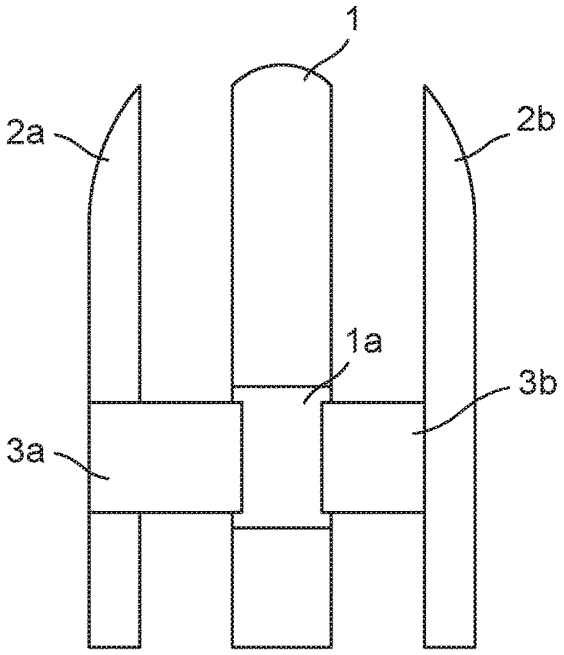
FIGS. 6, 8 and 10 show schematic views of an embodiment of the invention in different positions from above.
Figure 8:
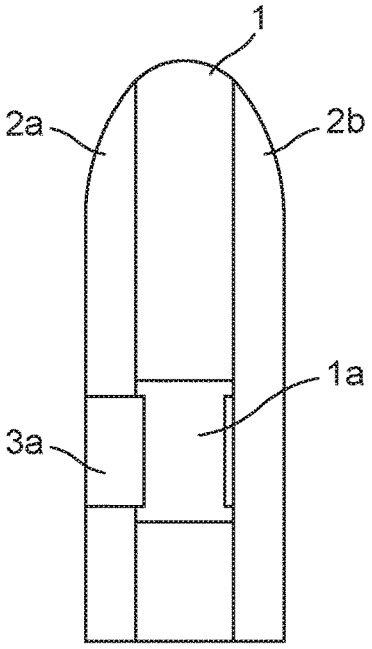
Figure 7:
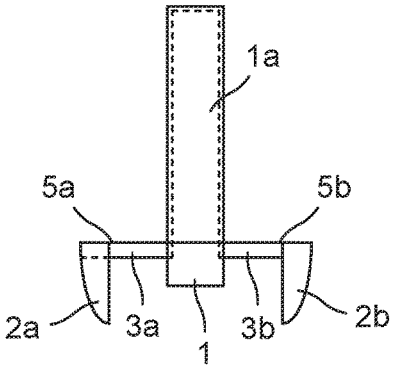
FIGS. 7, 9 and 11 show the positions of FIGS. 6, 8 and 10 in a rear view.
Figure 9:
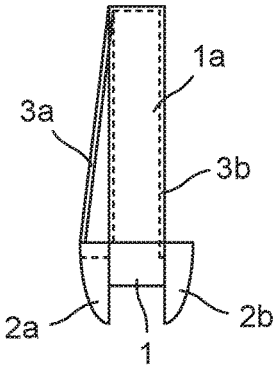
Figure 10:
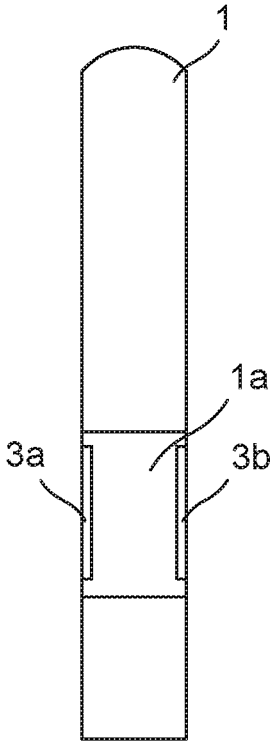
Figure 11:
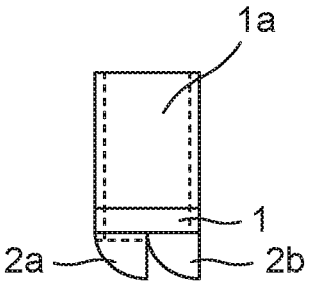

FIGS. 6 and 7 show the position of the outriggers 2*a*, 2*b* arranged with lateral distance from the main hull 1. FIGS. 8 and 9 show the outriggers 2*a*, 2*b* resting directly on the main hull 1. The illustrations show directly that the position of the pivoting arms 3*a*, 3*b* is different because the second pivoting axes 5*a*, 5*b* are attached on the outside in the left-hand half of the illustration, but on the inside in the right-hand half of the embodiment. FIG. 10 shows the position of the outriggers 2*a*, 2*b* beneath the main hull 1, with the left outrigger 2*a* being retracted and the right outrigger 2*b* being pivoted in, as has been explained above by reference to FIG. 1 and FIG. 2.

Figure 12:
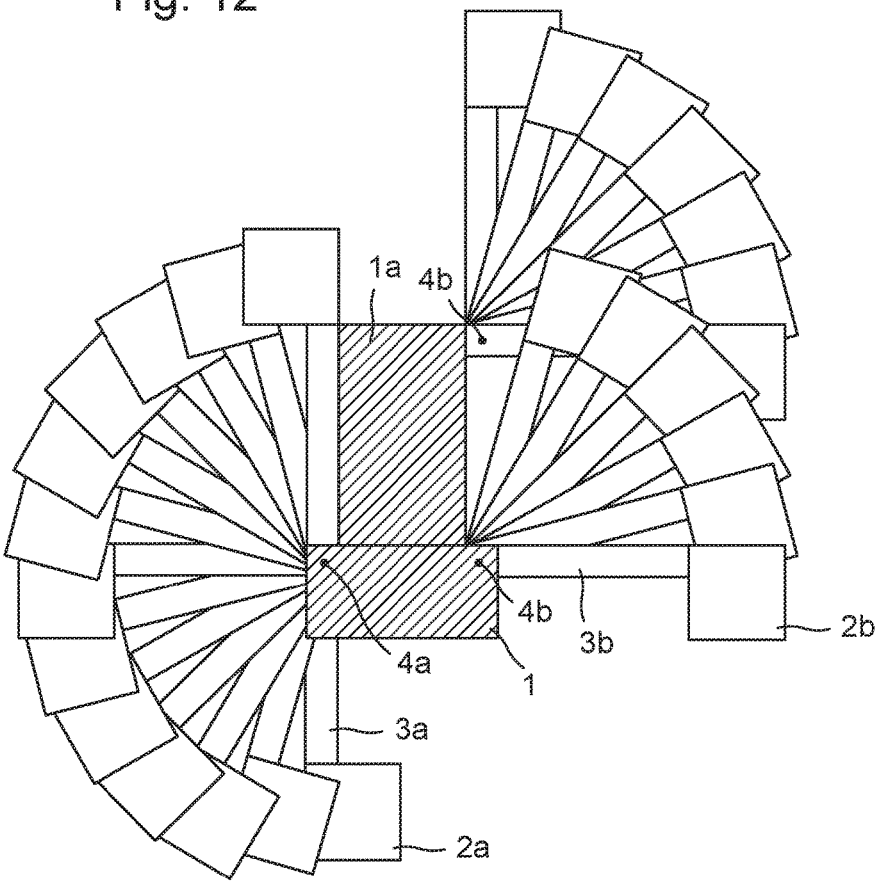
FIG. 12 shows a further schematic diagram of an embodiment of the invention.

FIG. 12 shows an embodiment of the invention with extended possibilities for movement. The left-hand half of FIG. 12 shows the movement range of the outrigger 2*a* when the first pivoting axis 4*a* has been lowered. The outrigger 2*a* can be brought not only to a position beneath the main hull 1, but can also be displaced further downwardly, so that the outrigger 2*a* has a distance from the main hull 1. The pivoting arm 3*a* can be pivoted from its horizontal position not only downwardly but also upwardly, so that the outrigger 2*a* can be brought to a position above the main hull 1. In addition, the first pivoting axis 4*b* can also be displaced upwardly by means of a sliding guide 7 (as shown in the right-hand half of FIG. 12), so that the range of movement of the outrigger 2*b* is increased even further.

Figure 13:
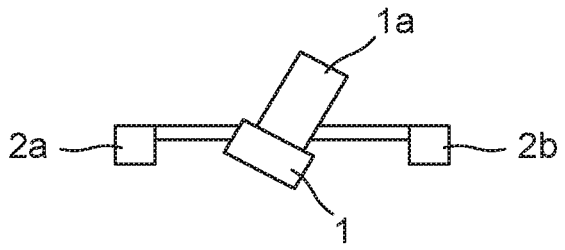
FIG. 13 shows a diagram for explaining the use of the invention.

The movement of the two pivoting arms 3*a*, 3*b* need not inevitably be arranged symmetrically in the embodiment of FIG. 12. In particular, the position of the pivoting axis 4*b* along the sliding guide 7 can be set continuously. The diagram of FIG. 13 shows that the left outrigger 2*a* has been lowered downwardly in an oblique manner as seen from the view of the main hull 1, whereas the right outrigger 2*b* has been lifted to the same extent. On the surface of water, the position as shown in FIG. 13 with a main hull 1 which is inclined in an oblique manner in the clockwise direction will be obtained, which is especially advantageous for travelling in curves for example. It is also possible to provide the counterbalancing of a lateral rolling motion in a swell.

Figure 14:
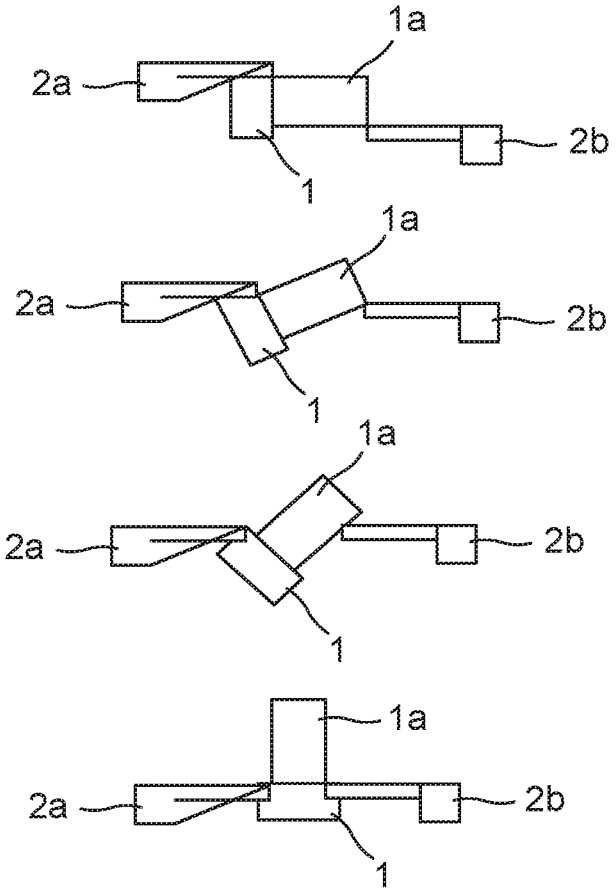
FIG. 14 shows four diagrams for explaining the use of the invention.

FIG. 14 shows in four diagrams how a watercraft with capsized main hull 1 can be put upright again. The outriggers 2*a*, 2*b* are brought to the lower or upper end position as seen from the main hull 1 and thereafter moved step by step to the middle position. The diagrams of FIG. 14 show the process of setting the main hull 1 upright from top to bottom.

Figure 15:
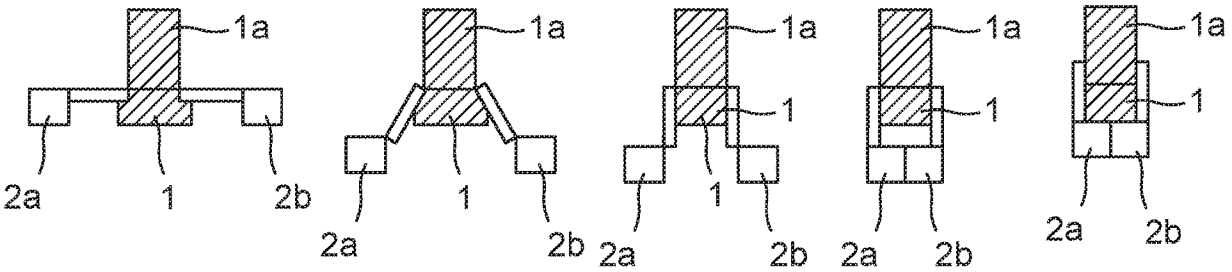
FIG. 15 shows five diagrams for explaining variability.
Figure 16:
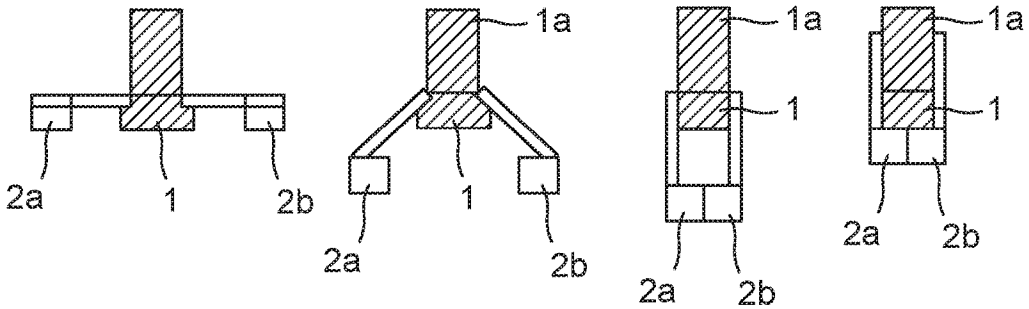
FIG. 16 shows four diagrams of an alternative embodiment in a view shown in FIG. 15.

FIGS. 15 and 16 show in five and four diagrams the extended possibilities of an embodiment according to FIG. 12. FIG. 15 relates to the principal configuration of FIG. 1 and FIG. 16 to the principal configuration of FIG. 2. As a result of these variants, a transformation of a trimaran via a catamaran to a monohull can be achieved in particular, with all associated changes in the travelling behavior and the properties.

Next to the standard outrigger position with outriggers 2*a*, 2*b* laterally at a distance from the main hull 1 as shown on the left-hand side, a catamaran of larger width can be shown in the second illustration. The third illustration of FIG. 15 shows a catamaran of reduced width, and in the fourth position the outriggers 2*a*, 2*b* are folded beneath the main hull 1 and displaced downwardly. This leads to an especially maneuverable but also unstable travelling behavior. The fifth illustration shows the outriggers 2*a*, 2*b* beneath the main hull 1, but directly resting on the same. The third and fourth illustration of FIG. 16 corresponds to the fourth and fifth illustration of FIG. 15.

Figure 17:
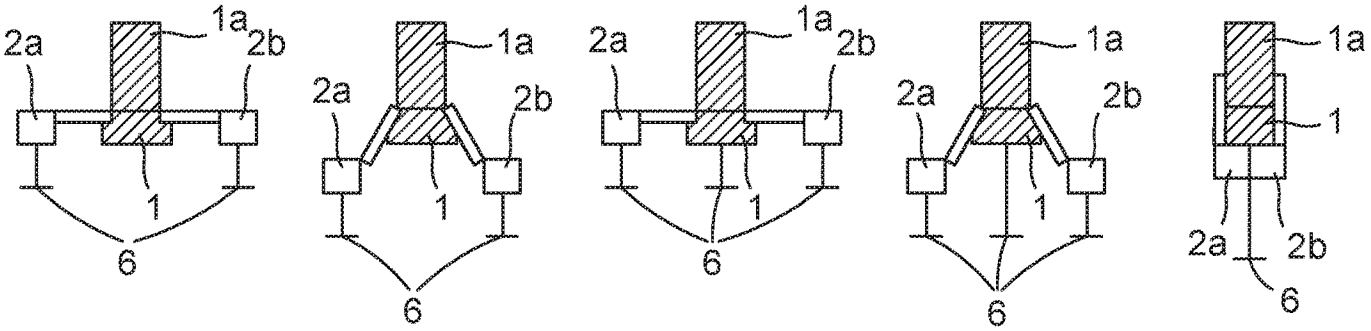
FIG. 17 shows five diagrams for explaining the possible positions of a further embodiment of the invention.

FIG. 17 shows five positions of an embodiment in which hydrofoils 6 are provided in an extendable manner both on the main hull 1 and also on the outriggers 2*a*, 2*b*. Hydrofoils that are not extended are not shown in the illustration for reasons of simplicity, which is justified in the respect that the hydrofoils 6 are accommodated in the retracted state in recesses that are not shown here.

The first illustration of FIG. 17 shows a position with outriggers 2*a*, 2*b* which are arranged at lateral distance adjacent from the main hull 1 with respectively extended hydrofoils 6. In the hydrofoil mode, this functionally concerns a catamaran. The second illustration corresponds to the first illustration with the difference that the main hull 1 is lifted in relation to the outriggers 2*a*, 2*b*. In this case too, the hydrofoils 6 are extended only on the outriggers 2*a*, 2*b*.

It is understood that the first two illustrations relate not only to a watercraft in which the hydrofoils 6 are present but retracted in the main hull 1, but also to a watercraft in which no hydrofoils are provided in the main hull 1.

The third illustration of FIG. 17 relates to a position according to the first illustration with the difference that the hydrofoils 6 have also been extended on the main hull 1. The fourth illustration corresponds to the second one, with the hydrofoils 6 of the main hull 1 being respectively further extended in order to cater for the elevated position of the main hull 1. In the fifth illustration, a hydrofoil 6 is extended only on the main hull 1, which hydrofoil is guided through the outriggers 2*a*, 2*b*.

Figure 18:
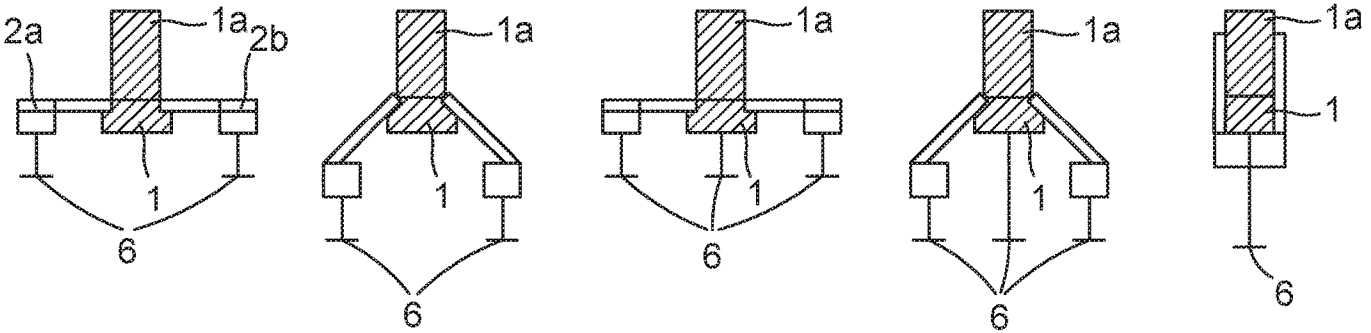
FIG. 18 shows five diagrams for explaining a further alternative embodiment of the invention.

FIG. 18 corresponds substantially to FIG. 17 with the difference that this illustration does not relate to the embodiment of FIG. 15 but to the embodiment of FIG. 16, respectively extended by the hydrofoils 6.

Figure 19:
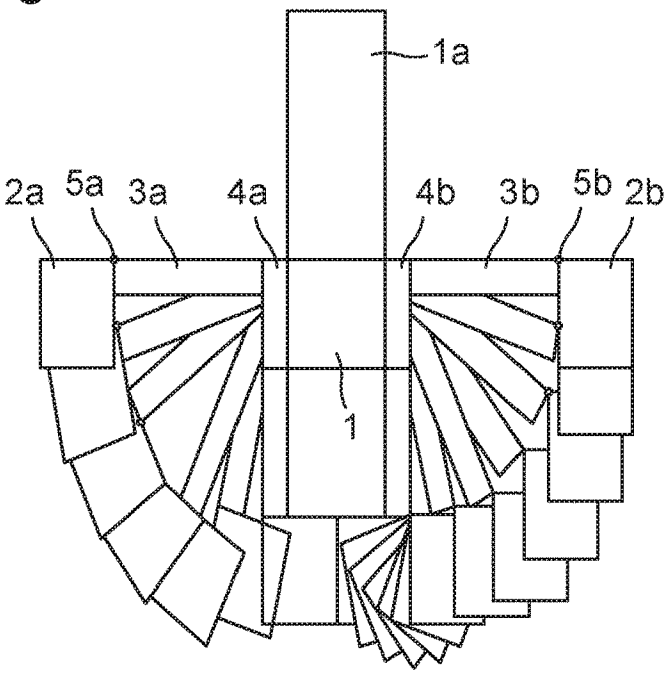

FIG. 19 shows two different movement modes for achieving the same end state in an embodiment according to FIG. 1. In the left-hand half of the illustration of FIG. 19, the outrigger 2*a* is lowered in that the pivoting arm 3*a* is pivoted in the anti-clockwise direction about the first pivoting axis 4*a*. No movement occurs in the second pivoting axis 5*a*, so that the outrigger 2*a* is lastly pivoted in the bottom position about 90° in relation to the upper position. In the right-hand half of FIG. 19, the outrigger is moved during the pivoting movement in the manner of a parallelogram guide and does not change its angular position. The outrigger 2*b* will be moved by a pivoting movement about the second pivoting axis 5*b* to its end position only when the pivoting arm 3*b* is in its perpendicular end position. The end position is identical in both cases for the outriggers 2*a*, 2*b*.

Figure 20:
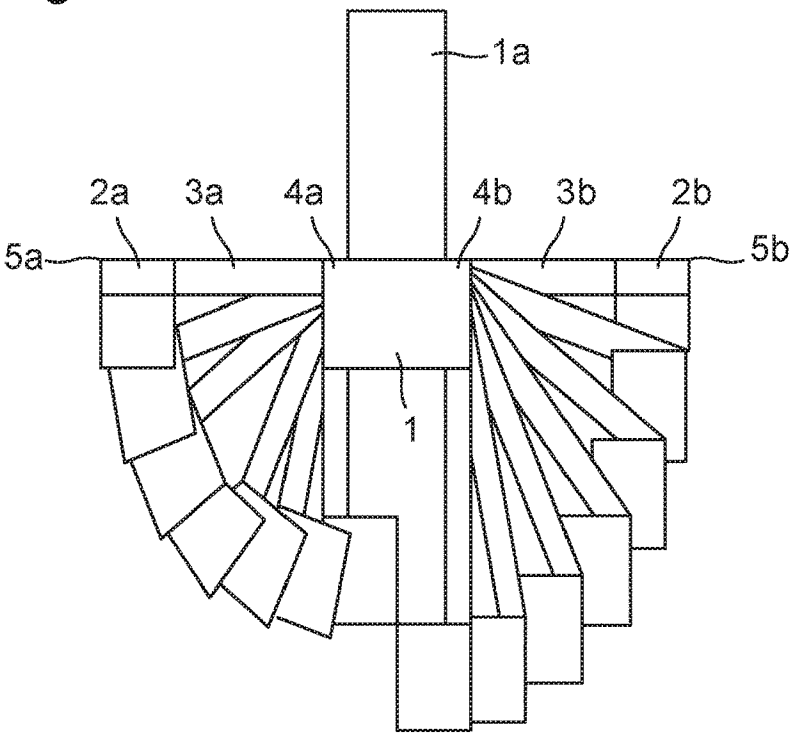
FIGS. 19 and 20 show further diagrams for explaining the movement possibilities.

FIG. 20 shows the pivoting movement of an embodiment according to FIG. 2. In the left-hand half of the illustration, a movement of the same type occurs as in FIG. 19. In the right-hand half of the illustration, the movement of the outrigger 2*b* is again shown in the manner of a parallelogram guide, with the pivoting movement not being performed in the end position so that the outrigger 2*b* remains parallel to its initial position.

Figure 22:
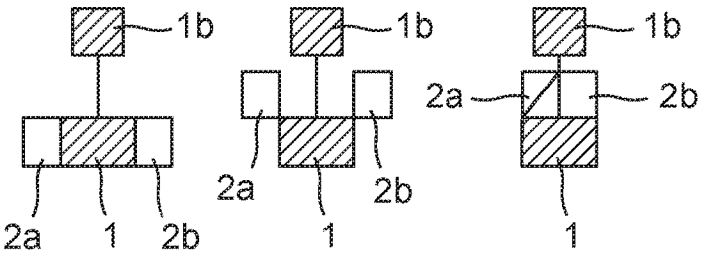
FIG. 22 shows three diagrams of an alternative embodiment.
Figure 21:
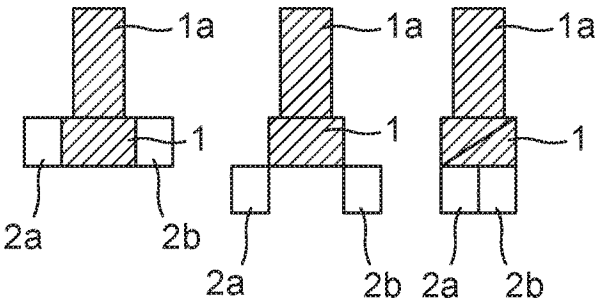
FIG. 21 shows three diagrams of a further embodiment.
Figure 21:
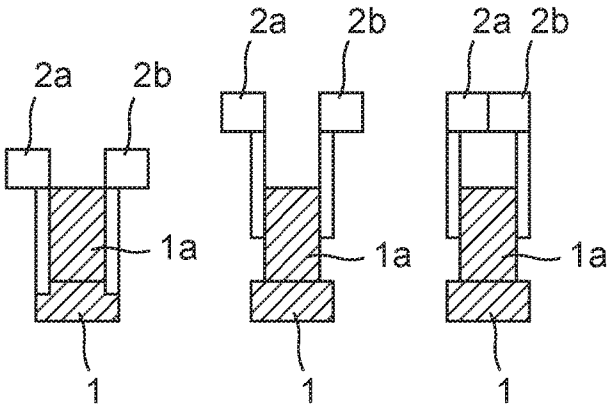
Figure 23:
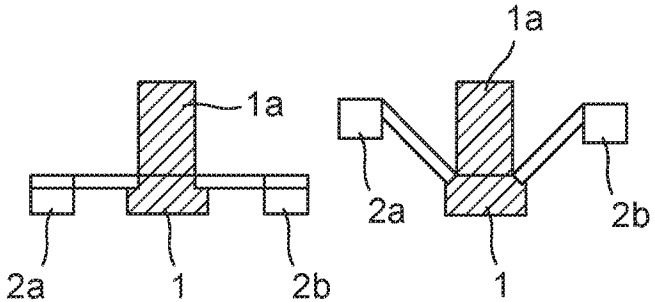
FIG. 23 shows five diagrams of a further alternative embodiment.
Figure 24:
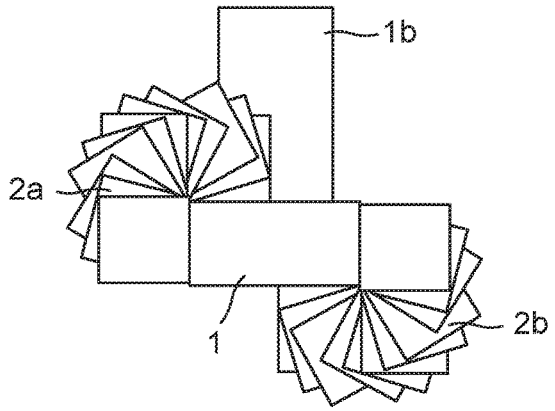
FIGS. 24 to 27 respectively show a diagram for explaining further embodiments.
Figure 26:
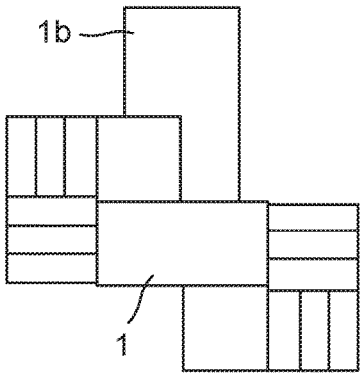
Figure 25:
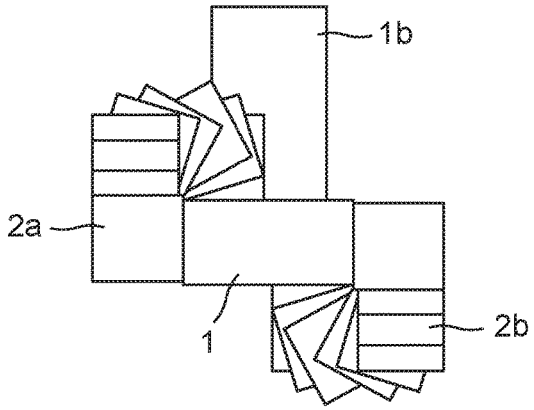
Figure 27:
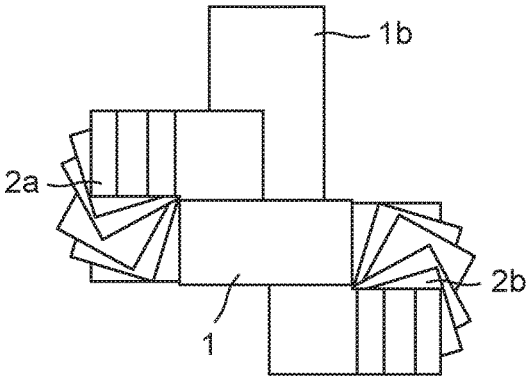

FIGS. 21 and 22 show different simplified embodiments of a watercraft in accordance with the invention, in which the outriggers 2*a*, 2*b* can only be pivoted with respect to the main hull 1. In the embodiment of FIG. 21, this pivoting movement occurs downwardly, whereas the pivoting movement occurs upwardly in the embodiment of FIG. 22. It is understood that the various superstructures lb of the main hull 1 need to be adjusted accordingly in FIG. 22 in order to enable this pivoting movement. FIG. 23 shows five different positions of an embodiment in which the outriggers 2*a*, 2*b* can be arranged in form of a roof above the main hull 1.

FIGS. 24 to 27 show further pivoting and displacing movements of outriggers 2*a*, 2*b* with respect to the main hull 1. The pivoting arm 3*a* has a very short length or is omitted (length→0).

Figure 28:
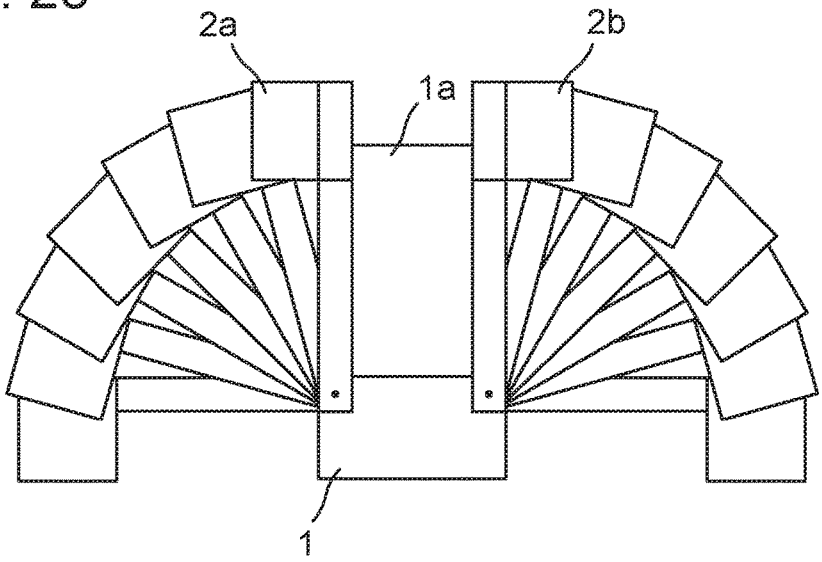
FIGS. 28 and 29 show further embodiments of the invention in a respective view from the front.
Figure 29:
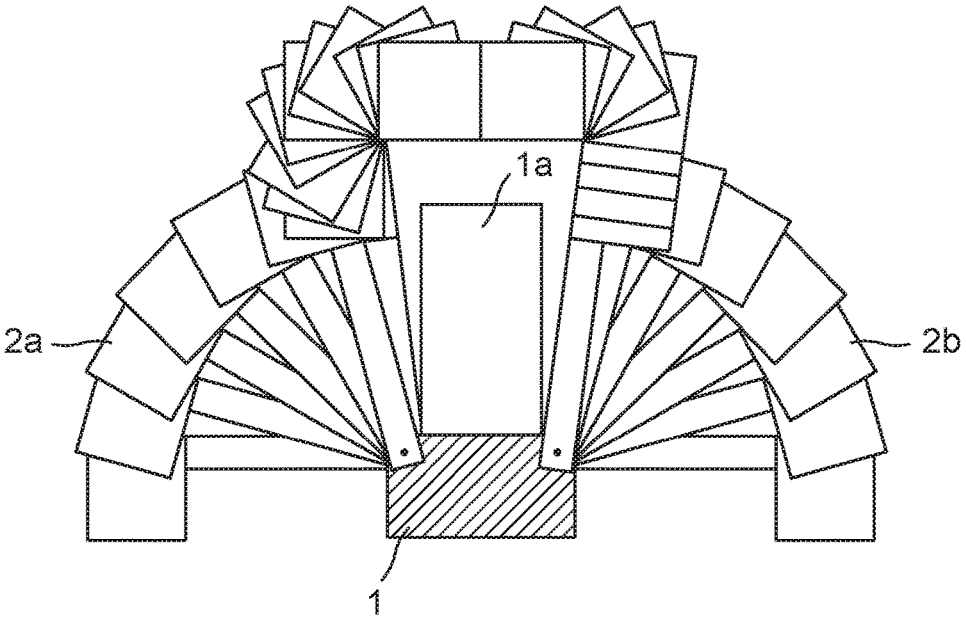

FIGS. 28 and 29 show different embodiments how the outriggers 2*a*, 2*b* can be arranged above the main hull 1, with a roof-like configuration of the outriggers 2*a*, 2*b* being achieved in FIG. 29 which can also be used as a roll-over cage for example.

In the embodiment of FIGS. 30 to 34, the outriggers 10*a*, 10*b* are respectively linked to a mechanism which consists of two mutually connected pivoting arms 3*a*, 3*c* and 3*b*, 3*d*. The outriggers 10*a*, 10*b* can be fastened to the outer pivoting arms 3*c*, 3*d* by being pivotable about a longitudinal axis in order to further increase variability.

Figure 30:
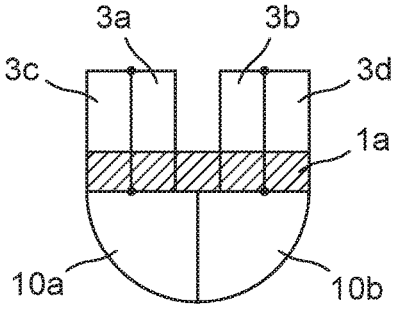
FIGS. 30 to 36 show a further embodiment of the invention in different positions.

In FIG. 30, the outriggers 10*a*, 10*b* are arranged beneath the main hull 1a, which in this case is only used as the carrier for the superstructures (not shown) and need not necessarily be floatable. The two outriggers 10*a*, 10*b* form a common compact hull at this point, i.e. they form the shape of the boat on their outsides and they rest substantially close to one another with their insides. This is a typical position for high-speed travel in which lateral stabilization occurs dynamically.

Figure 31:
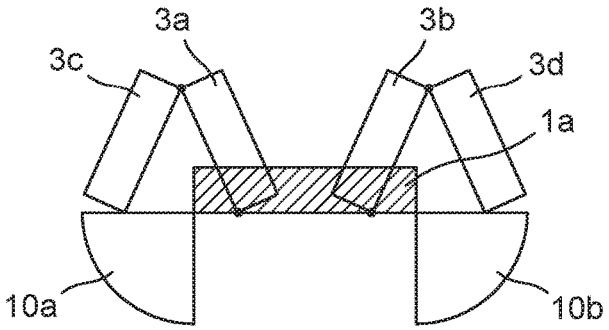

In the position of FIG. 31, the outriggers 10*a*, 10*b* are arranged laterally beneath the main hull 1*a* at a distance, thereby producing an inherently stable position.

Figure 32:
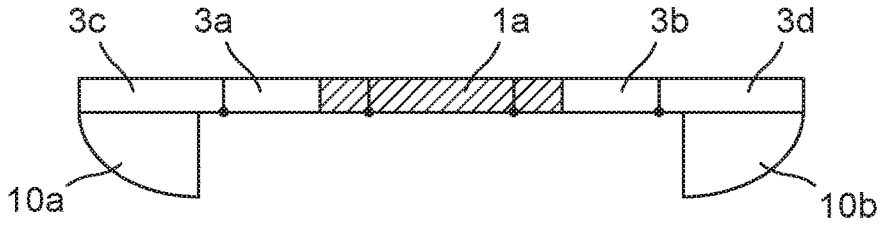

A further displacement of the outriggers 10*a*, 10*b* to the outside leads to the position according to FIG. 32, in which the pivoting arms 3*a*, 3*c* and 3*b*, 3*d* assume a stretched position.

Figure 33:
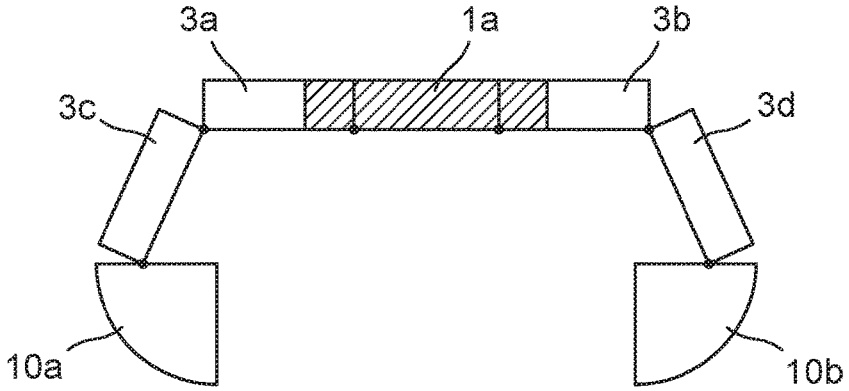
Figure 34:
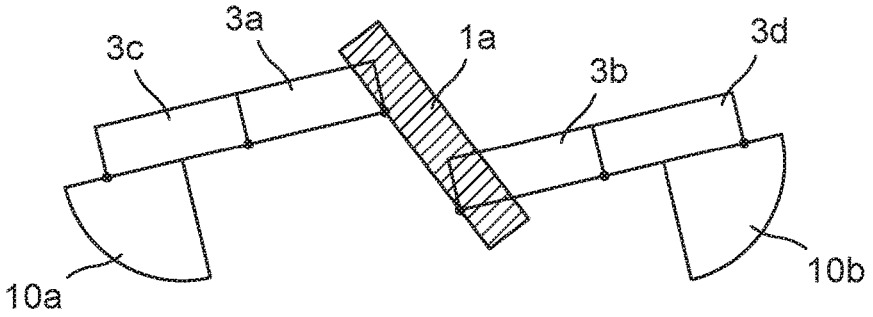

A further possibility for variation is shown in FIG. 33 in which the main hull la is lifted. FIG. 34 shows a position for travelling through curves with an inclined main hull 1*a*.

Figure 35:
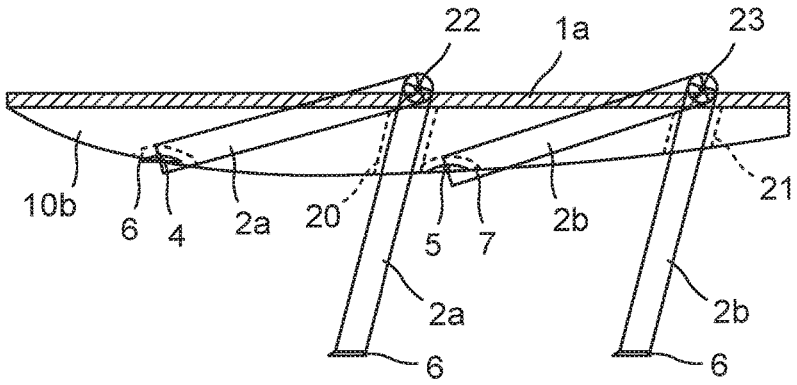
Figure 36:
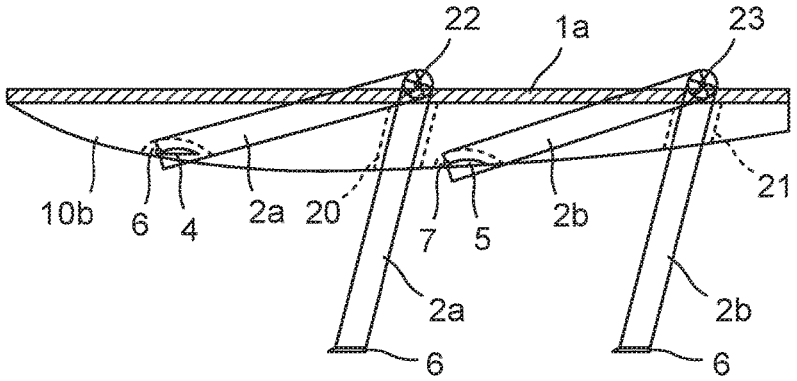

FIGS. 35 and 36 explain another aspect of this embodiment. The pivoting arms 2*a*, 3*a* carry the hydrofoils 6 which are therefore height-adjustable because the pivoting arms 2*a*, 3*a* are pivotable about the pivots 22 and 23. FIGS. 35 and 36 respectively show the pivoting arms 2*a*, 3*a* in a front retracted position in which the hydrofoils 6 are accommodated in the recesses, and in the extended position in which the hydrofoils 6 are arranged at a distance beneath the outriggers 10*a*, 10*b*. Reference numerals 20 and 21 indicate further recesses which are provided in the outriggers 10*a*, 10*b* on the inside in order to enable the passage of the pivoting arms 2*a*, 3*a* in the position of FIG. 30 through the outriggers 10*a*, 10*b* which otherwise rest directly on each other.

The invention claimed is:

1. A watercraft comprising:

a main hull with a superstructure;

outriggers fastened in a height-adjustable manner to the main hull, the outriggers configured for arrangement in the water between a first, active position spaced from a corresponding lateral side of the main hull, and a second, active position directly contacting each other beneath the main hull to fit along a common plane beneath the main hull to thereby form a common, compact hull; and a pivoting arm to fasten a corresponding one the outriggers to the superstructure, the pivoting arm pivotably and height adjustably linked to the superstructure, and pivotably linked to a corresponding one of the outriggers for movement in a direction perpendicular to a vertical axis of the superstructure in a manner such that the outriggers are to move laterally between the first, active position and a third, active position directly contacting the respective lateral side of the main hull.

2. The watercraft of claim 1, wherein a first pivot axis is arranged at a side of the outrigger which is adjacent to the main hull in the third, active position of the outrigger.

3. The watercraft of claim 1, wherein a first pivot axis is arranged at a side of the outrigger which is spaced from the main hull in the third, active position of the outrigger.

4. The watercraft of claim 1, wherein the outriggers are pivotably moveable about a first pivot axis.

5. The watercraft of claim 1, wherein the outriggers are moveable to a position beneath the main hull in response to movement of the pivoting arm along a second pivot axis.

6. The watercraft of claim 1, wherein the outriggers are moveable to a position above the superstructure in response to movement of the pivoting arm along a first pivot axis.

7. A watercraft comprising:

a main hull;

outriggers fastened in a height-adjustable manner to the main hull, the outriggers configured to for arrangement in the water between a first, active position spaced from a corresponding lateral side of the main hull, and a second, active position directly contacting each other beneath the main hull to fit along a common plane beneath the main hull to thereby form a common, compact hull; and a pivoting arm to link a respective one of the outriggers to the hull, the pivoting arm being linked at:

a first pivot axis to a corresponding one of the outriggers for movement in a manner such that the corresponding one of the outriggers is to thereby move laterally between a third, active position directly contacting the corresponding lateral side of the main hull, and the first, active position, and a second pivot axis to the main hull for movement along a vertical axis of the main hull, and movement of the outriggers away or toward the vertical axis.

8. The watercraft of claim 7, further comprising hydrofoils arranged on the outriggers.

9. The watercraft of claim 7, further comprising hydrofoils arranged on the main hull.

10. A watercraft comprising:

a main hull with a superstructure;

outriggers fastened in a height adjustable manner to the main hull and linked via a first pivot axis to the superstructure, the outriggers configured to for arrangement in the water between a first, active position spaced apart from a corresponding lateral side of the main hull, and a second, active position directly contacting each other beneath the main hull to fit along a common plane beneath the main hull to thereby form a common, compact hull; and a pivoting arm pivotably and height-adjustably linked to the superstructure at the first pivot axis, and linked via a second pivot axis to the at least one outrigger, the pivoting arm being pivotally moveable about the first pivot axis in response to movement in a direction parallel to a vertical axis of the superstructure, and in a manner such that the outriggers are to thereby move laterally between a third, active position directly contacting the corresponding lateral side of the main hull, and the first, active position.

11. The watercraft of claim 10, wherein the first pivot axis is arranged at a side of the outriggers which is adjacent to the main hull in the third, active position of the outrigger.

12. The watercraft of claim 10, wherein the outriggers are pivotably moveable about the first pivot axis.

13. The watercraft of claim 10, wherein the outriggers are moveable to the second, active position in response to movement of the pivoting arm along the second pivot axis.

14. The watercraft of claim 10, wherein the outriggers are moveable to a position above the superstructure in response to movement of the pivoting arm along the first pivot axis.

* * * * *